United States Patent [19]

Funke

[11] 4,071,015

[45] Jan. 31, 1978

[54] WHEEL DRESSING DEVICE

[75] Inventor: Manfred Maximilian Funke, Cincinnati, Ohio

[73] Assignee: Cincinnati Milacron Inc., Cincinnati, Ohio

[21] Appl. No.: 788,065

[22] Filed: Apr. 15, 1977

[51] Int. Cl.[2] ..... B24B 53/08

[52] U.S. Cl. ..... 125/11 AT; 51/60; 125/11 TP

[58] Field of Search ..... 125/11 M, 11 T, 11 AT, 125/11 R, 11 TP; 51/60

[56] References Cited

U.S. PATENT DOCUMENTS

| | | | |
|---|---|---|---|
| 1,668,746 | 5/1928 | Turner | 125/11 TP |
| 2,930,373 | 3/1960 | Jessup et al. | 125/11 TP |
| 3,120,723 | 2/1964 | Jessup | 125/11 AT X |

*Primary Examiner*—Harold D. Whitehead
*Attorney, Agent, or Firm*—Thomas M. Farrell

[57] ABSTRACT

An angled cam bar is slidable across a pair of base-carried supports so that the cam bar attitude varies in its travel, and a pivot point on the cam bar thereby traces out a locus of curvature, while a dressing stylus depending from the pivot point likewise traces out the locus of curvature on a grinding wheel. The supports are biased to a first position so as to generate a first portion of the locus of curvature, and means as provided to move one of the supports at one end of the first locus portion so as to generate a second portion of the locus of curvature as the bar continues traversal.

4 Claims, 13 Drawing Figures

WHEEL DRESSING DEVICE

BACKGROUND OF THE INVENTION

In grinding machines, and particularly grinders for finishing bearing races such as tapered roller bearing cones, it is frequently necessary to form a "crown" on the bearing truck, so that under subsequent loading, the crown or raised portion of the track will deflect, tending to create a straight raceway. Since the amount of crowning is often in the nature of approximately 50 millionths of an inch across a one inch wide track, for example, it can be appreciated that the radius of curvature of any portion of the crown is substantially great. Because the height of the crown is so small, it is not necessary that the crowned length be a perfect radius, but rather, it is sufficient if the crowned track is merely some curvilinear surface which has the requisite amount of center-of-track crown, terminating at the track ends. In the process of rough-turning of bearings, a relief portion is very often provided at the ends of the track to provide a relief area for an amount of grinding wheel which will slightly overhang the ends of the track.

Because of the great radius of curvature of the crowned track, it can be appreciated that a radial swinging mechanism would be impractical to apply to a grinder from an actual swing point. Several novel prior art devices, however, have been effectively used in creating the crown. One type of prior art device simply drags a follower across a curved surface and, as the follower is attached to a dependent dressing stylus, the stylus will trace out the same curvature on a dressing wheel. This type of dressing device has several disadvantages, in that the dressing cam can wear, and is therefore incapable of consistently dressing a constant shape on the wheel. Further, the crown shape is difficult to purposely vary, since it is not generated, and additional cams would be required.

A second prior art device involves a novel arrangement for generating a locus of curvature on a grinding wheel, wherein an angled cam bar is slid across a pair of simple supports in a direction substantially parallel to a wheel face desired to be crowned. The cam bar has a pivot point which traces out a locus of curvature as the cam bar attitude varies during cam bar traversal across the fixed simple supports. A dressing stylus depends from the pivot point and thereby traces out the identical generated locus of curvature on a grinding wheel. The radius of curvature tends to be less at the midspan point between the simple supports, and the locus of curvature becomes flatter, with an increased radius of curvature as the pivot point approaches each support. This second prior art device has lent itself well to providing a crown curvature to roller bearing tracks. However, a substantially sharp corner is created at the ground track ends as the flattened radius of curvature intercepts the relief portions in the bearing. It has been found through bearing research that the sharp corner created by the track end and the relief portion tends to break down after a period of use, and further, that if the track portion is blended by a smooth radius into the relief portion at the ends, that bearing life may be substantially increased.

No such prior art devices as previously described, contain a means for generating a substantially sharper radius of curvature at the ends of a substantially large locus of curvature. Applicant has obviated the problems inherent in the prior art devices, by a novel device for dressing a grinding wheel, which incorporates substantially similar parameters as the aforementioned cam bar dressing device, wherein a first portion of a locus of curvature is generated in a substantially similar manner to the prior art device, but a predetermined ends of the first portion of the locus of curvature, the cam bar support is moved in such fashion as to create a sharper radius of curvature in the locus of curvature as the cam bar continues traversal.

It is therefore an object of the present invention to provide a wheel dressing device for generating a locus of curvature on a dressing wheel having a first portion of substantially large radii of curvature, and second and third portions contiguous to said first portion, wherein said second and third portions are of substantially reduced radii of curvature.

SUMMARY OF THE INVENTION

The invention is shown embodied as an improved wheel dressing device for generating a locus of curvature from a set of dressing parameters which include: (a) a pair of base-carried supports; (b) an angled cam bar biased against the supports; (c) a pivot point on the cam bar; (d) a powered slide means to traverse the cam bar and pivot point slidably across the supports and the reverse, so that cam bar attitude varies in its traversal and the pivot point thereby dresses a locus of curvature; and (e) a dressing stylus which depends from the pivot point by a slide arrangement so as to trace out the identical locus of curvature as the pivot point; wherein the improvement comprises (a) springs to bias the supports to a first position against predetermined stops so that a first portion of a locus of curvature is generated as the bar is traversed, and dog plates are carried by the cam bar and contact the supports at the ends of the first portion of the locus of curvature. The supports are carried on pivotable links on the base, and the dog plate will drive the pivotable link away from the first position, causing generation of second and third portions at respective ends of the central first portion of the locus of curvature as the cam bar continues forward and reverse traversal. Further, in the preferred embodiment, the second and third radii of curvature are substantially less than the first portion of the locus of curvature, thereby creating "sharper" radius end portions on the wheel.

DESCRIPTION OF THE PREFERRED EMBODIMENT

Figure 1:
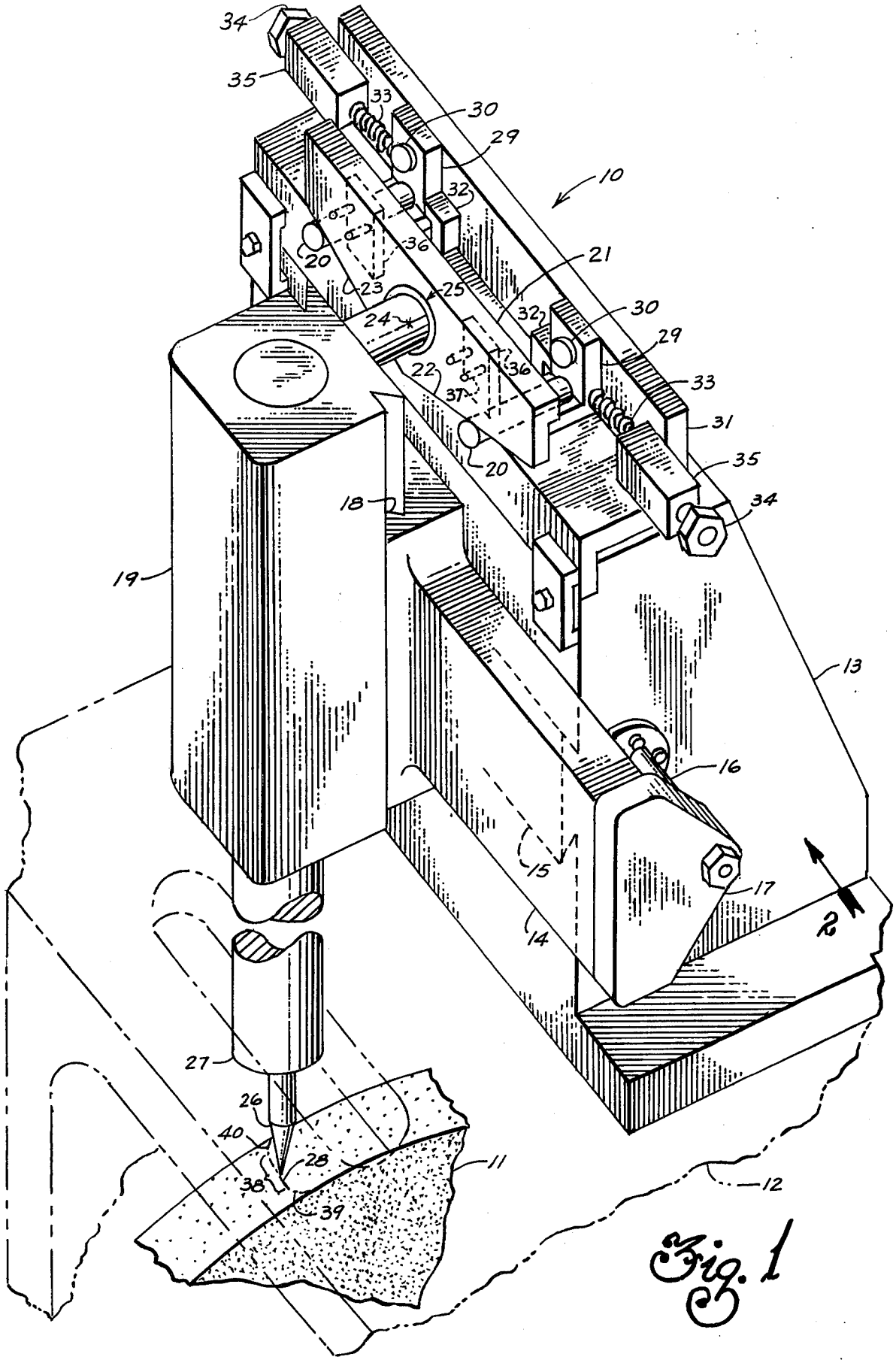
FIG. 1 is a perspective view of a wheel dressing device of the present invention.

Referring now to the drawings and to FIG. 1 thereof, there is shown a wheel dressing device 10 for dressing a rotatable grinding wheel 11. A grinding wheelhead 12 is shown in phantom, and a dresser base 13 is shown affixed to the grinding wheelhead 12 to remain stationary with respect to the grinding wheel 11. The dressing device 10 is of the type having a cross slide 14 guided on dovetail ways 15 on the dresser base 13 and powered by a piston 16 coupled to the cross slide 14 through an end apron 17, so as to propel the cross slide 14 to and fro relative to the dresser base 13. The cross slide 14 has a set of dovetail ways 18 normal to the dresser base ways 15, and the cross slide ways 18 support a diamond bar 19, for relative movement therewith radially to the grinding wheel 11. The dresser base 13 carries a pair of supports 20, which are comprised of hardened rods. An angled cam bar 21 is biased against the supports 20, having its angled faces 22, 23 in contact therewith. While the cam bar 21 is shown gravity-biased, it may be appreciated that other suitable biasing means may be substituted for appropriate biasing force. The relative angulation of the cam bar faces 22, 23 is shown exaggerated, since, in actual application, the cam bar 21 depicted has angled faces 22.23 which deviate from a straightedge, in the nature of a degree or two. The cam bar 21 has a pivot point 24 established thereon by an antifriction pivot joint 25 (shown simplified for clarity; detailed in FIG. 8) and the diamond bar 19 is connected to the pivot joint 25 so as to depend from the pivot point 24. The diamond bar 19 carries a diamond dressing stylus 26 at its lowermost end 27, to dress a locus of curvature 28 on the grinding wheel 11. As the cross slide 14 is powered to and fro relative to the dresser base 13 under the influence of the piston 16, the cam bar 21 will be slid across the supports 20, and the cam bar attitude will vary so as to cause the pivot point 24 and dressing stylus 26 to trace out a locus of curvature 28 in accordance with the directional components established by the coordinate movements of the cross slide 14 and the diamond bar 19. The supports 20 are carried by pivotable links 29 which swing on a pivot pin 30 established in the dresser bracket 31, and the links 29 are biased against stop blocks 32 by biasing springs 33 which react against adjusting screws 34 carried in adjusting blocks 35 mounted to the dresser bracket 31. A pair of dog plates 36 are carried by the cam bar 21 and are fixed thereto by screws 37. As the cam bar 21 is traversed midspan between the supports 20 as depicted, a first portion 38 of the locus of curvature 28 is generated on the dressing wheel 11, wherein the first portion 38 has a relatively large radius of curvature. Thereafter, the cam bar 21 approaches one of the supports 20 at an end of the first portion 38 of the locus of curvature 28, the dog plate 36 will contact a support 20, driving the support 20 arcuately away from the first position, 38 and causing generation of a second locus portion 39 as the cam bar 21 continues traversal. Similarly, as the cam bar 21 is reversed in its travel it will, upon reaching the other end of the first portion 38 of the locus of curvature 28, cause the other dog plate 36, to strike the other of the supports 20, driving the support 20 arcuately away from the stop block 32, and causing generation of a third locus 40 portion as the cam bar 21 continues reverse traversal.

The pivotable links 29 are of predetermined length and tend to move the support 20 in simultaneous coordinates corresponding to the directions of the cross slide 14 and diamond bar 19, so as to decrease the radii of curvature of the second and third locus portions 39, 40, thereby creating a locus of curvature 28 having a flattened first central portion 38, and substantially sharper second and third portions 39, 40 at the ends of the first portion 38.

Figure 2:
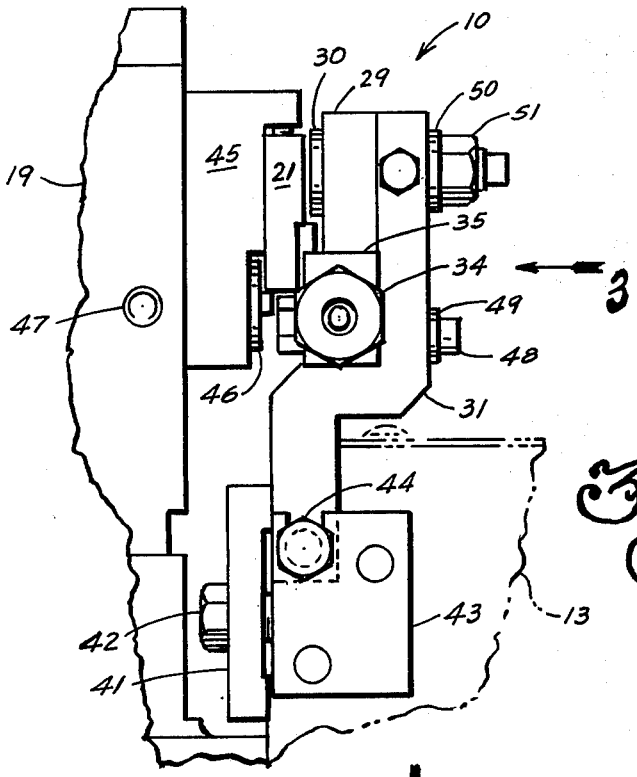
FIG. 2 is a side elevation of the wheel dressing device taken in the direction of arrow 2 of FIG. 1.

FIG. 2 is a more exacting view of the details of the dresser device 10 of FIG. 1, and depict in elevation, the dresser bracket 31 which is clamped to the dresser base 13 by means of a clamp 41 and screw 42. An adjusting block 43 is affixed to the dresser base 13 and an adjusting screw 44 is axially stationary with respect to the adjusting block 43 and rotatable therewith. The adjusting screw 44 is threadably received in the dresser bracket 31 to provide setup adjustment. The angled cam bar 21 is shown affixed to a pivot block 45 (which was not depicted in FIG. 1, for reasons of clarity). The pivot block 45 is pivotable relative to the pivot pin 46, and the pivot pin 46 is secured to the diamond bar 19 by a set screw 47. The spring-bias adjusting screw 34 is shown threadably received in the adjusting block 35, and the block 35 is secured to the dresser bracket 31 by a cap screw 48 and washer 49. The pivotable link 29 is carried on its link pivot pin 30 which is established in the bracket 31, and the link pivot pin 30 is clamped from relative movement with the dresser bracket 31 by a washer 50 and nut 51 which is threadably received on the link pivot pin 30.

Figure 3:
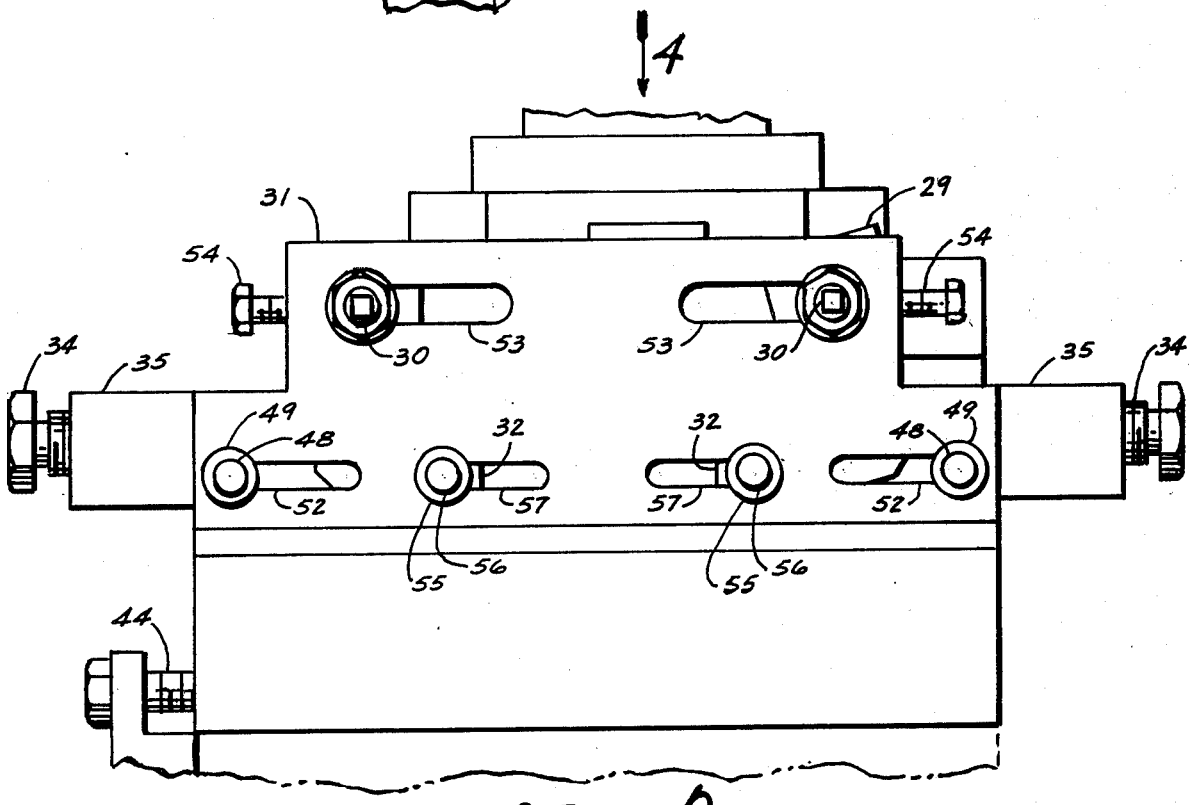
FIG. 3 is a rear elevation of the wheel dressing device taken in the direction of arrow 3 of FIG. 2.

The rear elevation of FIG. 3, shows the dresser bracket 31 and adjusting screw 44. The bracket 31 has slots 52 to adjust the position of the spring-bias adjusting blocks 35, and additional slots 53 are provided to move the link pivot pins 30 with respect to one another for setup purposes. Backup screws 54 are threadably received in the dresser bracket 31 to assist in preventing subsequent movement of the link pivot pins 30 after they have been adjusted and clamped. Washers 55 with cap screws 56 inserted through the dresser bracket 31 serve to clamp the stop blocks 32 in position, and slots 57 are provided for the adjustment of the stop blocks 32. One pivotable link 29 is shown positioned at the complete end of cam bar traversal.

Figure 4:
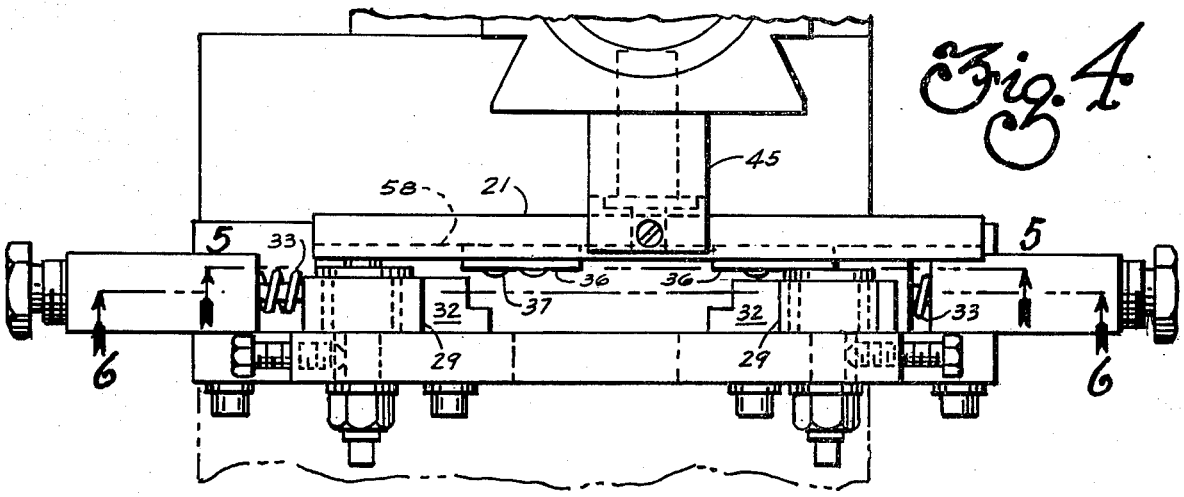
FIG. 4 is a plan view of the wheel dressing device taken in the direction of arrow 4 of FIG. 3.
Figure 5:
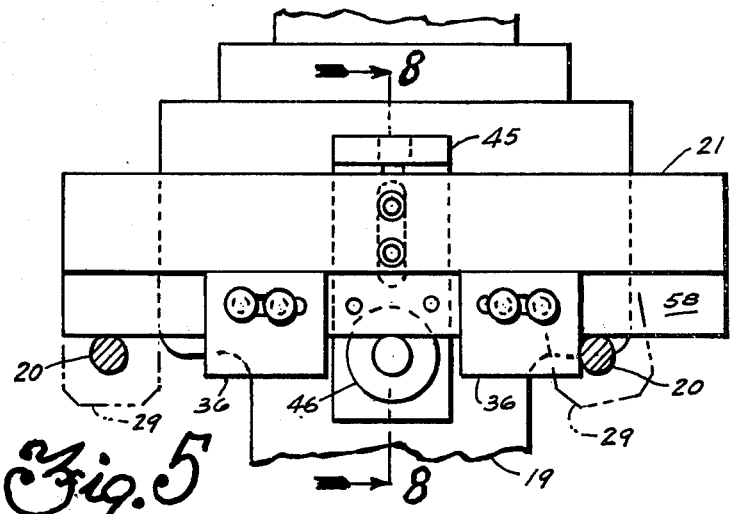
FIG. 5 is a elevational section taken along the line 5—5 of FIG. 4.

The plan view of FIG. 4 further shows the arrangement of the stop blocks 32 relative to the pivotable links 29, and the links 29 are acted upon by the biasing springs 33. The cam bar 21 is shown affixed to the cam pivot block 45 and the dog plates 36 are carried in a relief portion 58 in the cam bar 21 with buttonhead screws 37 affixing the dog plates 36 to the cam bar 21. The section of FIG. 5 more clearly indicates the specific relationship of the cam bar 21 to the supports 20, wherein the supports 20 are shown carried by the links 29 (shown in phantom). The dog plates 36 are affixed to the cam bar 21 in the relief portion 58, and the cam bar 21 is carried by the cam pivot block 45. The pivot block 45 is pivotally journalled on the pivot pin 46 which is carried by the diamond bar 19.

Figure 7:
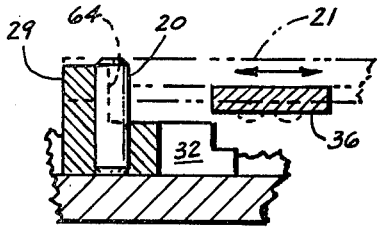
FIG. 7 is a plan section taken along the line 7—7 of FIG. 6.
Figure 6:
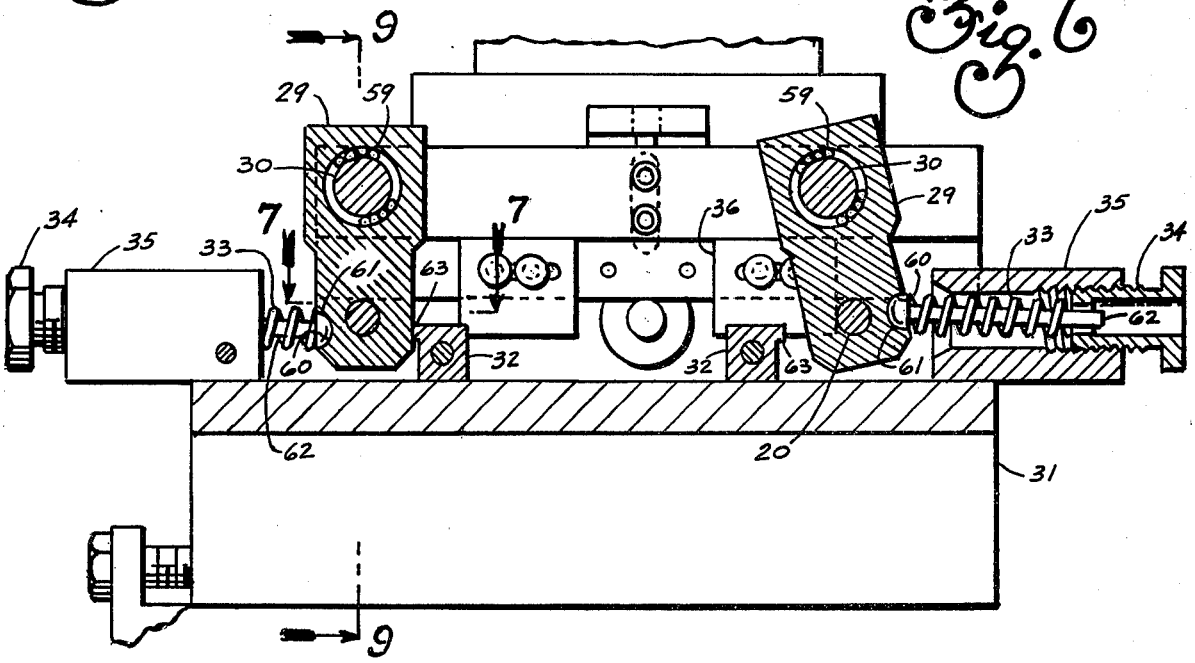
FIG. 6 is an elevational section taken along the lines 6—6 of FIG. 4.

Referring to FIG. 6, the pivotable links 29 are shown supported by link pivot pins 30 and appropriate antifriction bearing assemblies 59. The pivotable links 29 have a side pocket 60 machined to bear on the spherical head 61 of guide pins 62, inserted through the helical biasing springs 33. The guide pin 62 prevents the spring 33 from buckling and creates a smooth ball and socket relationship with the pivotable link 29. The biasing spring adjusting screw 34 is shown threadably received in the adjusting block 35, which is affixed to the dresser bracket 31. The stop blocks 32 are clamped to the dresser bracket 31 and have a stop shoulder 63 which is engaged by the pivotable links 29. The cam bar 21 is shown at one end of its traversal, having a dog plate 36 in contact with a support 20, wherein the support 20 is driven away from the block 32, overcoming the biasing force of the spring 33. The plan section of FIG. 7, shows the relationship of the dog plate 36 to the support 20. The rod-like support 20 is shown carried by the pivotable link 29, and the link 29 is relieved in one portion 64, to insure that the dog plate 36 will strike the support 20. The stop block 32 is shown in contact with the link 29, and the cam bar 21 is shown in phantom.

Figure 8:
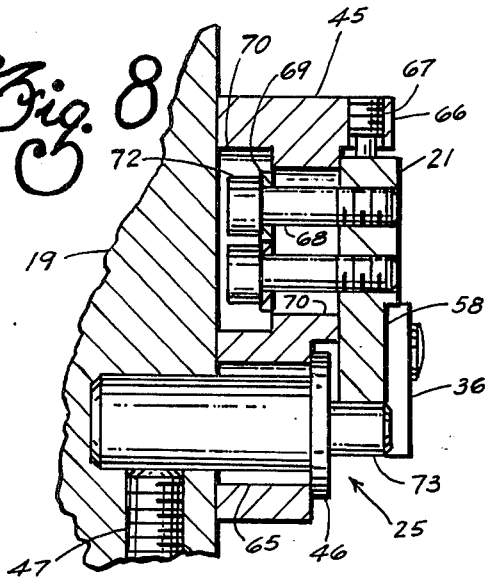
FIG. 8 is an elevational section taken along the line 8—8 of FIG. 5.

The elevational section of FIG. 8 is taken through the pivot joint 25 of the cam bar 21 and diamond bar 19, illustrating that the cam pivot block 45 is pivotably carried through an antifriction needle bearing assembly 65 on the pivot pin 46 which is affixed to the diamond bar 19 by a set screw 47 (shown out of position). The block 45 has an upper portion 66 extending out over the cam bar 21 and a set screw 67 is provided through the upper portion 66 to provide a backup for the cam bar 21. The cam bar 21 is held to the pivot block 45 by cap screws 68 and washers 69, which are inserted through a slot 70 and threadably received in the cam bar 21. A slotted counter-bore 71 is provided in the pivot block 45 to accept the heads 72 of the cap screws 68 and the washers 69. A locating stud 73 extends from the pivot pin 46 and provides a resting place for the cam bar 21 for setup purposes. The dog plate 36 is shown affixed to the relief portion 58 of the cam bar 21.

Figure 9:
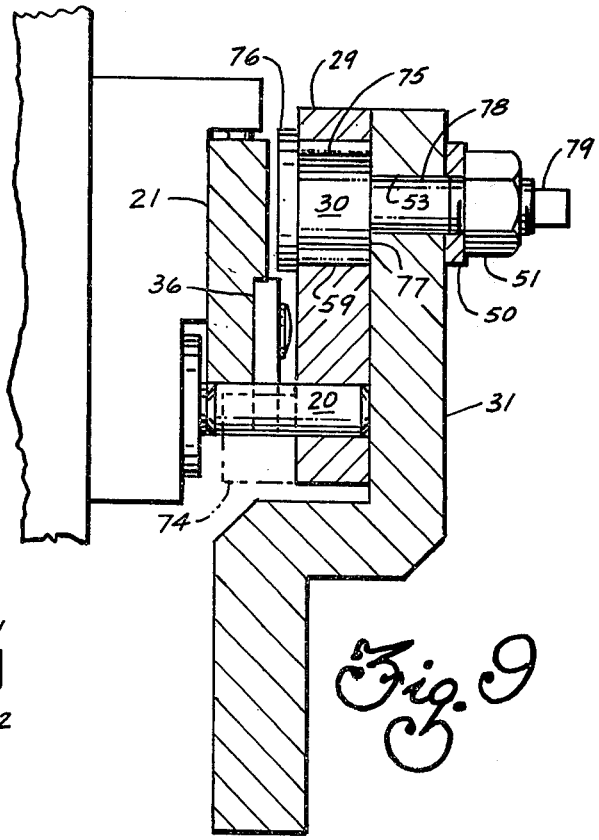
FIG. 9 is an elevational section taken along the line 9—9 of FIG. 6.

FIG. 9 is an elevational section through the pivotable link 29, showing the rod-like support 20 extending therefrom and the cam bar 21 is resting on the support 20. A foot 74 of the link 29 is shown in phantom, as it is relieved in the area of the dog plate 36. The link pivot pin 30 is cylindrical, having a bearing diameter 75 which is journaled in an antifriction needle bearing assembly 59 in the link 29, and a head 76 is provided on the pin 30 to entrap the link 29 from relative axial movement therewith. A shoulder 77 is provided on the pivot pin 30 which abuts the dresser bracket 31, and a stud portion 78 of the pin 30 extends through the slot 53 in the dresser bracket 31. A nut 51 is threadably received on the stud portion against a washer 50 and the bracket 31. The outermost nut end of the pin 30 is provided with a square shank 79 for convenience in tightening the nut 51.

Figure 10:
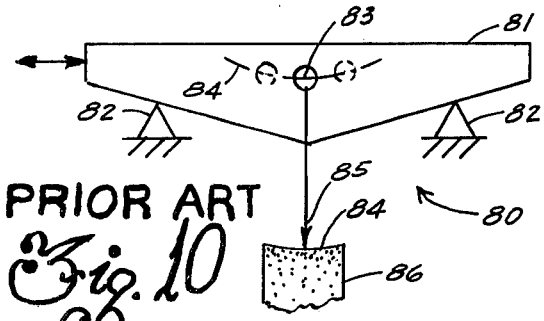
PRIOR ART Fig. 10
FIG. 10 is a diagrammatic view of a prior art wheel dressing device.

FIG. 10 is a diagrammatic view of a cam bar dressing device 80 of the prior art, wherein the dresser cam bar 81 is traversed across a pair of fixed simple supports 82 in the direction of the arrow, and a pivot point 83 on the cam bar 81 traces out a locus of curvature 84 as the cam bar 81 varies in attitude during traversal. A dresser stylus 85 depends from the pivot point 83, and duplicates the locus of curvature 84 on a dressing wheel 86.

Figure 11:
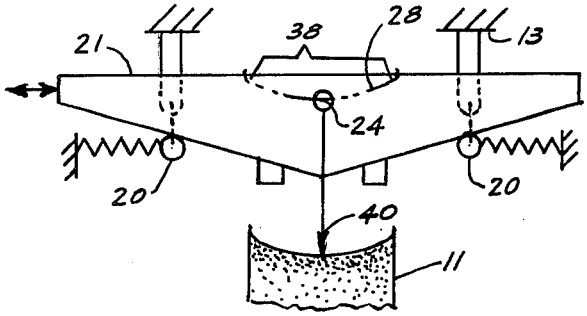
FIGS. 11, 12, and 13 are diagrammatic views of the wheel dressing device of the present invention.
Figure 12:
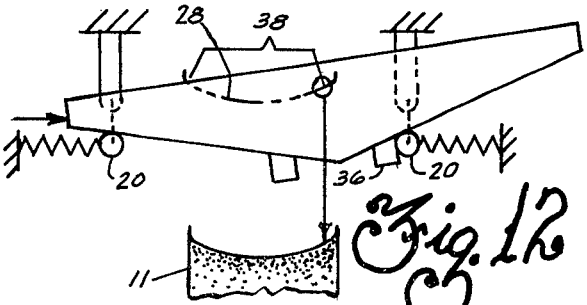
Figure 13:
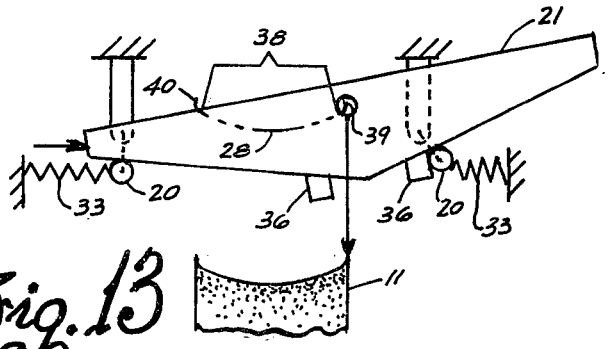

FIGS. 11, 12 and 13, clearly depict the function of the instant invention in diagrammatic form. Referring to FIG. 11, the cam bar 21 is shown supported by a pair of movable rod-like supports 20, which are carried on pivotable links 29 supported by a dresser base 13. The supports 20 are biased to a first position, so that as the cam bar 21 is traversed across the supports 20 in the direction of the arrow, a pivot point 24 on the cam bar 21 will trace out a first portion 38 of a locus of curvature 28. The dressing stylus 40 depends from the pivot point 24 and duplicates the locus of curvature 28 on a grinding wheel 11. Here, the cam bar 21 is shown midway between the supports 20, traveling to the right of the viewer. FIG. 12 illustrates that at the end of the first portion 38 of the locus of curvature 28, a dog plate 36, carried by the cam bar 21, contacts the right support 20 as the left support 20 remains relatively stationary. Further movement as depicted in FIG. 13, moves the link-carried right support 20 through an arcuate path, overcoming the force of the biasing spring 33, and generates a sharper radius of curvature as a second portion 39 of the locus of curvature 28 contiguous to the first portion 38, while the left support 20 remains relatively stationary. As the cam bar 21 is reversed in travel, the right support 20 will reassume its first, relatively fixed position, as the first portion 38 of the locus of curvature 28 is traced out, and at the other end of the first portion 38 of the locus of curvature 28, a dog plate 36 will contact the left support 20 and overcome the left biasing spring 33, generating a third portion 40 of the locus of curvature 28 as the bar 21 continues its reverse traversal.

What is claimed is:

1. An improved wheel dressing device for generating a locus of curvature from a set of dressing parameters which include:

a. a pair of base-carried supports;
b. an angled cam bar biased against said supports;
c. a pivot point on said cam bar;
d. means to traverse said cam bar and pivot point in a first direction across said supports and the reverse, wherein the cam bar attitude varys so as to move said pivot point simultaneously in a second direction normal to said first direction; and
e. a dressing stylus depending from said pivot point so as to trace out a locus of curvature in accordance with first and second directional components; wherein the improvement comprises:
f. means to bias said supports to a first position so as to generate a first portion of a locus of curvature as said bar is traversed; and
g. means to move one of said supports at one end of said first portion so as to generate a second portion of said locus of curvature as said bar continues traversal comprising:
   a. a pivotal link, carrying said one of said supports pivotally on said base; and
   b. a dog plate, carried by said cam bar, wherein as said cam bar is traversed relative to said base, said dog plate contacts said one of said supports, driving said support arcuately away from said first position and causing generation of said second locus portion as said cam bar continues traversal.

2. The device of claim 1, wherein said means to bias said supports comprises a spring reacting against said link and base.

3. The device of claim 1, further including means to move the other of said supports at the other end of said first portion so as to generate a third portion of said locus of curvature as said cam bar continues reverse traversal.

4. The device of claim 3, wherein said other of said supports is movable in said second direction, normal to said first direction of traverse, so as to decrease the radius of curvature as said first locus portion blends to said third locus portion.

* * * * *